US007059700B2

(12) United States Patent
Aihara

(10) Patent No.: US 7,059,700 B2
(45) Date of Patent: Jun. 13, 2006

(54) INK JET RECORDING APPARATUS FOR PERFORMING RECORDING IN ACCORDANCE WITH REMAINING AMOUNT OF INK, AND CONTROL METHOD FOR THE APPARATUS

(75) Inventor: Yoshihiko Aihara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 10/765,992

(22) Filed: Jan. 29, 2004

(65) Prior Publication Data

US 2004/0183845 A1 Sep. 23, 2004

(51) Int. Cl.
*B41J 29/38* (2006.01)
*B41J 29/393* (2006.01)

(52) U.S. Cl. ..... 347/14; 347/19

(58) Field of Classification Search ..... 347/19, 347/43, 16, 14; 358/504
See application file for complete search history.

(56) References Cited

U.S. PATENT DOCUMENTS 6,196,663 B1 * 3/2001 Wetchler et al. ..... 347/43
6,962,399 B1 * 11/2005 Anderson et al. ..... 347/14

FOREIGN PATENT DOCUMENTS

JP 5-181364 7/1993
JP 7-25030 1/1995

* cited by examiner

*Primary Examiner*—Lamson Nguyen
(74) *Attorney, Agent, or Firm*—Fitzpatrick, Cella, Harper & Scinto

(57) ABSTRACT

The present invention relates to an ink jet recording apparatus.

According to the present invention, in the operating mode wherein a recording operation can be continued even when the amount of ink on which the management process is based is exhausted, when an instruction for performing the recording operation is issued, whether a predetermined operation has been performed using manipulation means provided for the recording apparatus is confirmed, and the recording operation is initiated after the predetermined operation has been performed by a user.

Thereby, when the actual amount of ink is exhausted, there is prevented such trouble that the main body of a printer or a recording head would be damaged.

7 Claims, 9 Drawing Sheets

INK JET RECORDING APPARATUS FOR PERFORMING RECORDING IN ACCORDANCE WITH REMAINING AMOUNT OF INK, AND CONTROL METHOD FOR THE APPARATUS

BACKGROUND OF THE INVENTION

1. Field of the Invention

The present invention relates to an ink jet recording apparatus for discharging ink and recording an image on a recording medium. In particular, the present invention relates to a system for detecting or managing the remaining amount of ink in an ink tank that is detachably mounted in an ink jet recording apparatus.

2. Description of the Related Art

As a recording apparatus (hereinafter also referred to as a printing apparatus) using an ink jet technique, there is a well known "bubble jet (registered trade mark)" type recording apparatus wherein ink is evaporated, using thermal energy generated by a heat generating element (heater) employed as a recording element, and is discharged by the expansive force exerted by bubbles formed in the ink during the evaporation process.

However, when this ink jet recording apparatus continues to perform the ink discharge and conduct a recording process after the ink supply has been exhausted, the heated recording head cannot undergo, the cooling effect produced by evaporation. Further, when the recording head continues to be driven under the condition that the ink supply has been exhausted, either the heat generating element of the recording head will be damaged, so there is a danger that thereafter insufficient thermal energy is produced for the discharge of ink, or the heat generating element is actually broken.

To avoid this defect, a method has been practically employed whereby an electric element (hereinafter referred to as an EEPROM), which enables electric erasure and writing, is provided for an ink tank to manage the remaining amount of ink.

According to this method, as ink is consumed, the remaining amount of ink, or the amount of ink consumed, is constantly written to the EEPROM, so that the amount of ink consumed or the remaining amount of ink in the ink tank can be managed. Specifically, methods are available for predicting, based on image data, the amount of ink to be discharged, for counting the number of dots discharged, in accordance with the image data, and for directly counting the number of times the heat generating element was driven.

When through this management a value representing the remaining amount of ink, for example, has reached zero, only the performance of the recording operation need be inhibited to prevent damage to the recording head due to heat generation.

An invention related to the management of the remaining amount of recording agent is disclosed in Japanese Patent Laid-Open Publication No. H05-181364. In this publication, a configuration is proposed whereby an image forming operation is inhibited when the supply of toner has been exhausted, and subsequently, whether or not the toner has been supplemented can be precisely determined, so that the inhibition imposed on the performance of the image forming operation can be correctly removed. Furthermore, according to another configuration, disclosed in Japanese Patent Laid-Open Publication No. H07-025030, management of the image forming process is based on the number of sheets that can be recorded using the remaining ink, and when the ink supply in a tank is exhausted, the image recording process is halted until the empty tank has been replaced by a new one.

By the above described management of the remaining amount of ink, the printing operation is halted when the supply of ink is exhausted to prevent damage to the recording head.

However, depending on environmental conditions, the amount of ink that is actually discharged may vary slightly. Therefore, to avoid a condition wherein the control remaining amount of ink reaches zero before the remaining amount of ink on which the management process is based reaches zero, it has been considered that the latter amount of ink is so managed to reach zero slightly earlier than the former amount of ink. That is, taking user's convenience into account, it is inappropriate for the recording process to be disabled before the remaining amount of ink on which the management process is based reaches zero. In addition, to prevent damage to the recording head and to prompt a user to exchange ink tanks, it is generally employed such the configuration that the remaining amount of ink on which the management process is based is managed to be always lower than the actual remaining amount of ink, and thus it reaches zero before the ink has been exhausted actually.

With this arrangement, when the remaining amount of ink on which the management process is based reaches zero, the actual remaining amount of ink varies due to the above described factors, and it may be anticipated that the remaining ink remains enough to print of several pages. Further, even when the remaining amount of ink on which the management process is based reaches zero during a recording operation, the recording operation may be continued to avoid wasting the recording sheet that is currently being printed. Therefore, in design, there is desirable such specification that even when the remaining amount of ink on which the management process is based reaches zero, the recording operation is continued, or the recording operation is enabled in accordance with an instruction entered by a user.

As is described above, when the recording operation is enabled while the remaining amount of ink reaches zero, the running cost can be reduced, and user convenience is improved. However, if the recording operation is enabled without a limit being set, the ink will actually be exhausted, and a problem will occur.

It is also anticipated that the ink supply system is altered at a user's own risk so as to enable continuous recording even after the remaining amount of ink on which the management process is based reaches zero. In this case, ink may leak from the ink supply system, or a failure may occur due to an ill effect to the mechanism in the recording apparatus. It is difficult for a manufacture of an apparatus to guarantee the apparatus against any failure caused by an unexpected operation. Thus, when an apparatus is modified by a user to enable a recording operation when the remaining amount of ink on which the management process is based reaches zero, it is preferable that the failure of the apparatus itself be avoided and damage to the recording head be minimized. However, the conventional configuration can not cope with this problem.

SUMMARY OF THE INVENTION

The present invention is provided by focusing on the above described problems that have arisen in the management of the remaining amount of ink. It is one objective of the present invention to notify a user at a comparatively early time that when the recording operation is continued after the remaining amount of ink on which the management process is based has reached zero, the remaining ink has actually been exhausted and recording is no longer being performed, so that damage to a recording head can be minimized.

To achieve this objective, according to the present invention, an ink jet recording apparatus for discharging ink supplied from an exchangeably mounted ink tank to a recording medium through a recording head to thereby perform recording, comprising:

operating means for operating the ink jet recording apparatus and for changing a setup;

remaining amount management means for managing a remaining amount of ink in the mounted ink tank;

mode change means for, when it is determined that following the consumption of ink, the remaining amount of ink in the ink tank managed by the remaining amount management means has reached zero, switching between a first operating mode in which thereafter a recording operation using the recording head is inhibited, and a second mode in which the continuance of the recording operation is enabled regardless of the remaining amount of ink managed by the remaining amount management means; and control means for, when performance of the recording operation is instructed in the second operating mode, permitting the performance of the recording operation after a user's manipulation through the operating means.

Further, according to the present invention, the operating means includes on-line switching means for switching, between an on-line state and an off-line state, the state of a connection to a host that is externally connected to the ink jet recording apparatus and wherein when the performance of the recording operation is instructed in the second operating mode, the control means sets the state of the connection to the host to the off-line state, and then permits the performance of the recording operation after the user manipulates the on-line switching means to change the state to the on-line state.

The ink jet recording apparatus further comprises:

remaining amount detection means for detecting when the remaining amount of ink in the ink tank reaches a level equal to or lower than a predetermined amount wherein, when, in the first operating mode, the remaining amount detection means has not yet detected that the remaining amount of ink reaches a level equal to or lower than the predetermined amount, and when the amount of ink in the ink tank that has been consumed has exceeded a predetermined amount, the control means inhibits the performance of the recording operation.

Furthermore, according to the present invention, a method of controlling an ink jet recording apparatus for discharging ink supplied from an exchangeably mounted ink tank discharged to a recording medium through a recording head to thereby perform recording, comprising the steps of:

switching, when the remaining amount of ink to be managed is reduced, between a first operating mode in which the performance of a recording operation is inhibited and a second operating mode in which the performance of the recording operation is enabled; and confirming, when performance of the recording operation is instructed in the second operating mode, whether a predetermined manipulation has been performed through operating means provided for the ink jet recording apparatus; and controlling the performance of the recording operation to be permitted after the predetermined manipulation has been performed by a user.

As is described above, according to the present invention, when the recording operation is performed after the remaining amount of ink on which the management process is based has reached zero, the recording operation can be performed through user's manipulation of the main body of a printer. According to the present invention, a user can be notified at an early time of a defect or an abnormality that occurs when the actual remaining ink has been exhausted after the remaining amount of ink on which the management process is based reached zero and thus management of the amount of ink is no longer performed. As a result, damage to the main body of the printer and the recording head can be prevented, and the service lives of the printer main body and the recording head can be extended.

DETAILED DESCRIPTION OF THE PREFERRED EMBODIMENT

The preferred embodiments of the present invention will now be described in detail while referring to the accompanying drawings.

First Embodiment

Figure 1:
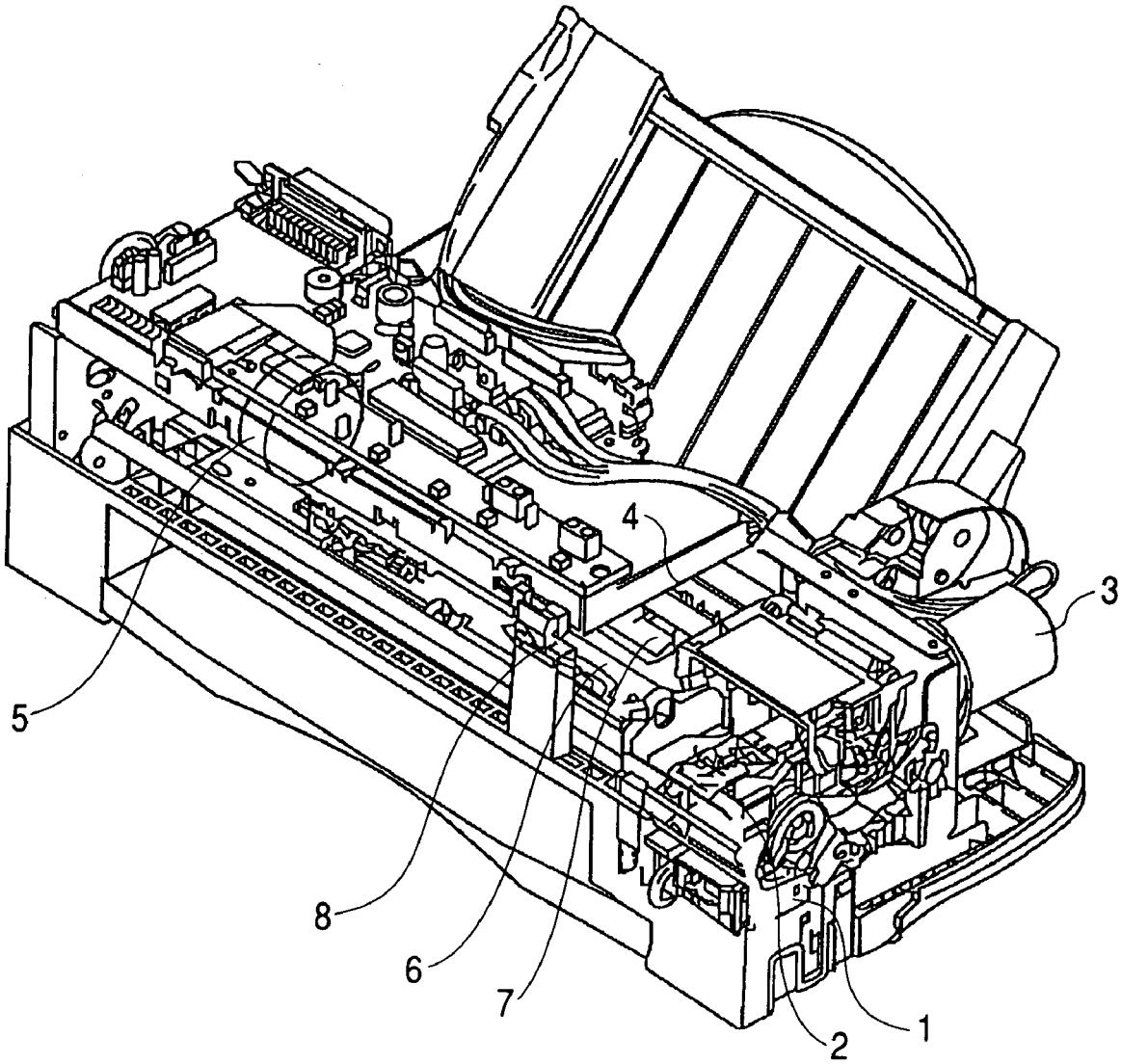
FIG. 1 is a perspective view of a recording apparatus for which the present invention can be applied.

FIG. 1 is a diagram showing the external appearance of the essential portion of a printer for which the present invention can be applied. The printer in FIG. 1, a so-called serial scan recording apparatus, records an image as a recording head scans in a direction (main scanning direction) perpendicular to a direction (sub-scanning direction) in which a recording medium is conveyed. During the recording operation, first, a recording medium is conveyed to a predetermined position by a feed roller 6 that is driven, through a gear, by a feed motor 5. Then, as a carriage 2 is moved in the main scanning direction by a carriage motor 3, ink is discharged from a recording head mounted on the carriage 2, and an image having a predetermined band width is recorded on the recording medium. Thereafter, the recording medium is conveyed a predetermined distance in the sub-scanning direction (hereinafter also referred to as "paper feeding").

By repeating this operation, images are sequentially recorded on the recording medium, and the image forming for the recording medium is completed.

For this serial scan system, there is a method for feeding a sheet after scanning by the recording head has been performed a plurality of times, instead of each time the recording head scans.

Further, there is another method in which for each scan of the recording head, thinned record data is recorded by using a predetermined mask and paper feeding is performed a distance equivalent to 1/n of a band width, whereby one band width image is completed by a plurality of times scans of the recording head and a plurality of times of paper feedings.

In this embodiment, a carriage belt 4 is employed as means for transmitting a drive force from the carriage motor 3 to the carriage 2. However, transmission means other than the carriage belt 4, such as a lead screw, may be employed. The recording medium that is fed passes between the feed roller 6 and a pressure roller 7, and is guided to a recording position for the recording head. In the halted state, the recording head is closed by the cap of a purge unit 1, while for the recording operation, the cap is released to permit the recording head to move in the main scanning direction along the carriage 2. Thereafter, after record data equivalent to one scanning have been accumulated in a buffer, the carriage 2 is moved in the main scanning direction by the carriage motor 3 and ink is discharged, through the recording head, to record an image. In this arrangement, ink is supplied from an ink tank, through an ink supply path such as a tube, to a recording head 9. Hereinafter, the total ink supply path, including the ink tank and the tube, is called an ink supply system.

Figure 2:
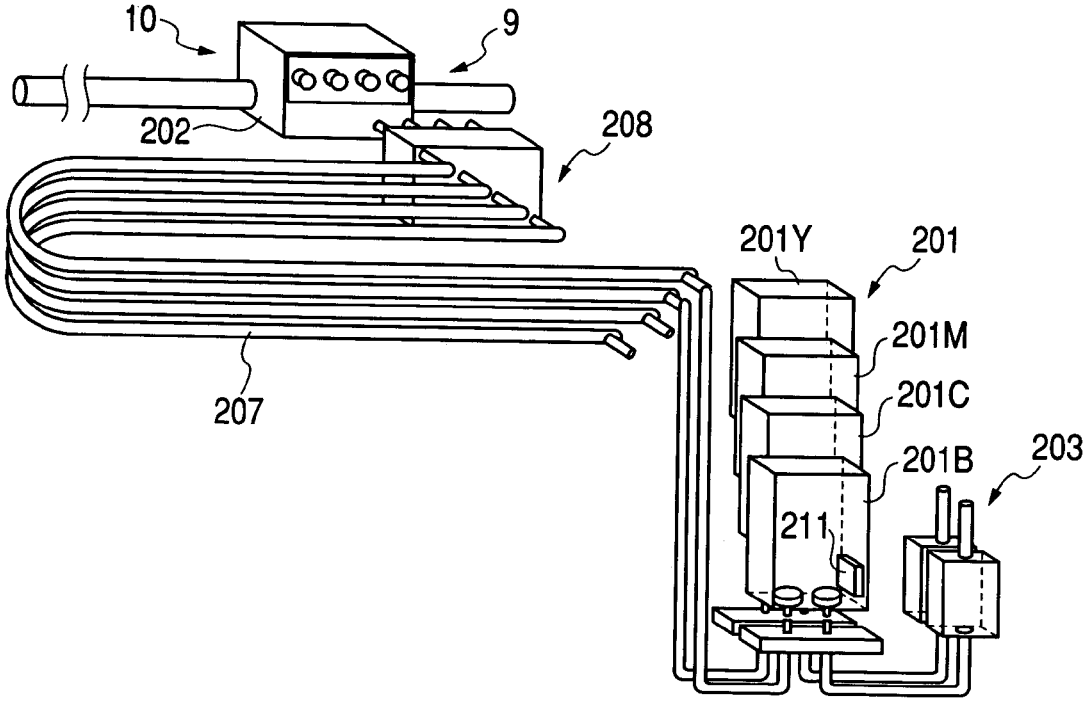
FIG. 2 is a diagram showing the arrangement of the ink supply system of the recording apparatus in FIG. 1.

FIG. 2 is a diagram for explaining the ink supply system of the recording apparatus in this embodiment. The ink from a main ink tank 201 supplementally flows through a tube 207 and a supply joint 208 to a sub-ink tank 202 on the carriage 2, and is then supplied to the recording head 9.

In the main ink tank 201, containers 201Y, 201M, 201C and 201B respectively store yellow, magenta, cyan and black ink. Together with the carriage 2, the recording head 9 is moved along a shaft 10 in the main scanning direction. Also provided in FIG. 2 is buffer chamber 203.

Instead of the arrangement shown in FIG. 2, ink from the main tank 201, which is located at a fixed position on the main body of the recording apparatus, may be supplied directly to the recording head 9. However, to minimize the load imposed on the carriage 2 to increase the recording speed, and to reduce the size and weight of the apparatus, it is effective, as in this embodiment, for a compact sub-ink tank 202 to be mounted on the carriage 2. That is, when a sub-ink tank 202 having a comparatively small capacity is mounted on the carriage 2, ink from the sub-ink tank 202 can be supplied to the recording head 9 and the ink stored in the sub-ink tank 202 can be supplemented by ink drawn from the main ink tank 201, which has a comparatively large capacity and is located at a fixed position on the main body of the recording apparatus.

When the carriage 2 is moved to a predetermined position, such as a home position, the supply joint 208 serves as an ink supply path extending between the main ink tank 201 and the sub-ink tank 202. Therefore, at an optimal time consonant with the capacity of the sub-ink tank 202 and the amount of ink consumed by the recording head 9, ink from the main ink tank 201 can be supplementally supplied the sub-ink tank 202.

A storage unit 211 attached to the main ink tank 201 is used to store the remaining amount of ink. By being attached to the main body of the printing apparatus, the storage unit 211 is electrically connected to the main body for the reading of internal data or the writing of data. This storage unit 211 is mounted for each of the ink tanks 201Y to 201B for the individual colors.

The main ink tank 201 is formed of a resin such as PP or PE by using a formation technique such as injection, blowing or welding. Examples for this tank 201 are a tank whose outer case functions directly as an ink chamber, a tank that includes a bag filled with ink, and a tank wherein ink is held by an internally provided porous member while, at the same time, a negative pressure is exerted. For example, when a negative pressure generation mechanism is provide in the main ink tank 201, a spring mechanism biased to expand an ink container bag may be provided inside or outside the bag to generate a negative pressure. In this embodiment, the supply system that includes the tube 207 shown in FIG. 2 is prepared, and a negative pressure generation source is provided by using a water head difference between the recording head 9 and the main ink tank 201.

Further, the main ink tank 201 in this embodiment is constructed by welding, to the PP outer case, a part serving as a bottom.

Any type of recording medium can be employed so long as it is appropriate for ink jet recording, and can be, for example, so-called plain paper, paper coated with an ink absorption layer made of calcium carbonate, $TiO_2$ or a bonding agent, or a polymer film on which an absorption layer of $Al_2O_3$ porous material is deposited to absorb ink.

Further, all of the known soluble organic solvents for ink can be used.

Figure 3:
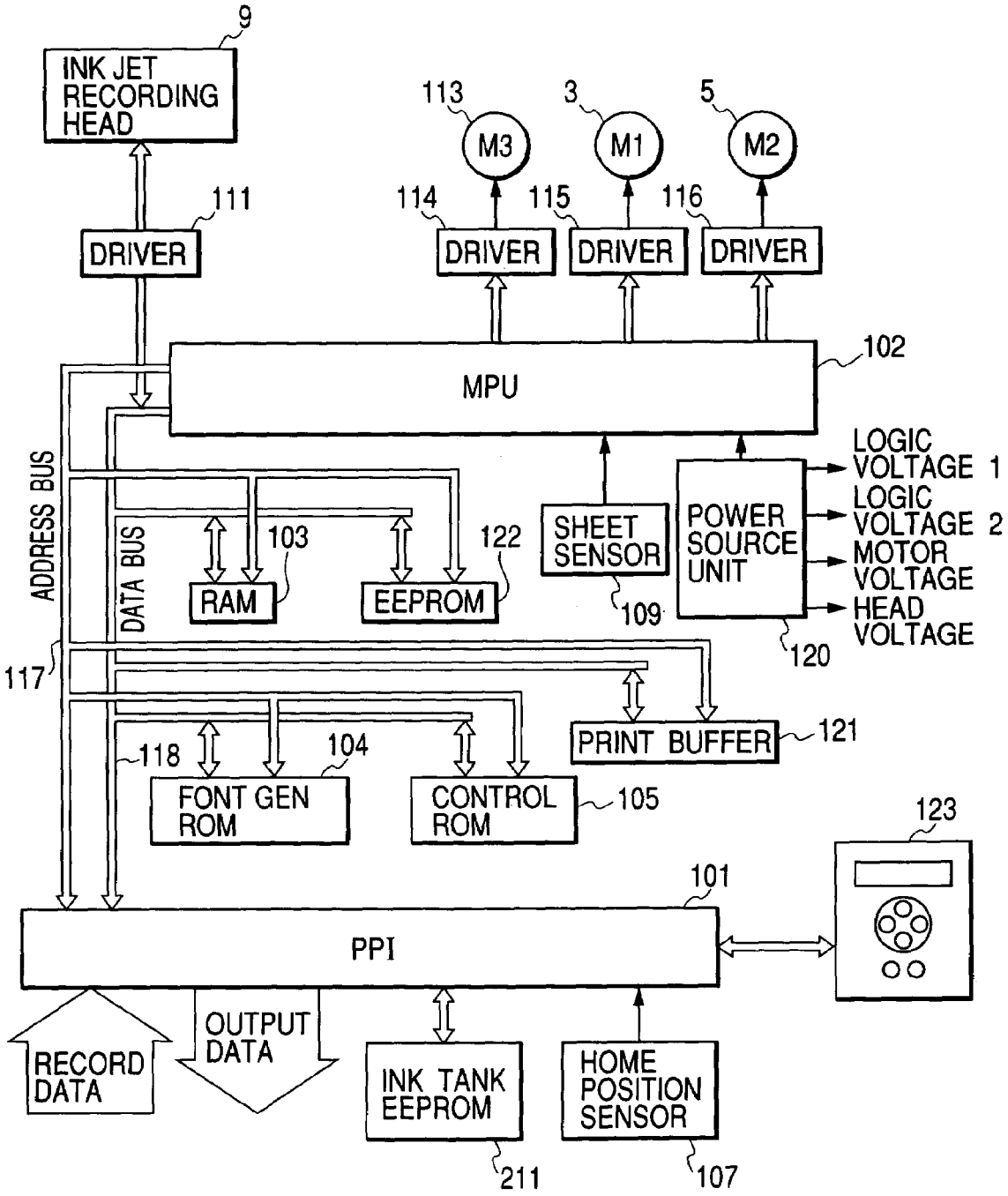
FIG. 3 is a block diagram showing the arrangement of the control system of the recording apparatus in FIG. 1.

FIG. 3 is a schematic diagram for explaining the arrangement of an electric circuit for the recording apparatus in this embodiment. In FIG. 3, a programmable peripheral interface (hereinafter referred to as a "PPI") 101 receives an instruction signal (command) and a record information signal from a host computer (host) (not shown), and transmits the signal to a micro processing unit (MPU) 102.

Further, the PPI 101 exchanges control signals with a panel 123 on which a display and operating keys are integrally formed, and also receives a signal from a home position sensor 107 that detects the presence of the carriage 2 at the home position. In addition, to perform data reading and writing, the PPI 101 exchanges control signals and data with the ink tank EEPROM 211.

The MPU 102 controls the individual sections of the recording apparatus in accordance with a control program stored in a control ROM 105. A RAM 103 is used to temporally store various data, and store received signals, or serves as a work area for the MPU 102. A font generation ROM 104 is used to store pattern information, such as characters and record information, in accordance with coding information, and various pattern information is output based on coding information that is input. A print buffer memory 121 is used to store data developed in the ROM 104, and has a record data memory capacity equivalent to m lines. The procedures to be executed by the MPU 102 are stored in a control ROM 105.

An EEPROM 122 for the printing apparatus is provided separately from the ink tank EEPROM 211.

Adjustment data concerning the operation of the printing apparatus, the history of its usage, etc. are written to the EEPROM 122 provided for the printing apparatus.

Control for these individual sections is provided by the MPU 102 via an address bus 117 and a data bus 118.

The carriage motor 3 moves reciprocally, in the main scanning direction, the carriage 2 on which the recording head 9 is mounted. The feed motor 5 conveys a recording medium, such as paper, in the sub-scanning direction perpendicular to the direction in which the carriage 2 is moved. A capping motor 113 drives a cap member that caps the recording head 9, so that the ink discharge orifice (not shown) of the recording head 9 can be isolated from the outside air and the drying of the nozzles can be prevented. Further, the capping motor 113 performs a wiping operation, i.e., drives a wiper, to wipe ink from the ink discharge orifice formation face (head face) of the recording head 9.

Motor drivers 115, 116 and 114 are respectively provided for driving the carriage motor 3, the feed motor 5 and the capping motor 113. And a keyboard switch and a liquid crystal display device are provided for the display and key operating panel 123. As will be described later, this operating panel 123 is used by a user to designate or change an operation and the setup of the recording apparatus.

A home position sensor 107 is located near the home position of the carriage 2, and detects that the carriage 2, on which the recording head 9 is mounted, reaches the home position. A sheet sensor 109 detects the presence of a recording medium such as a recording sheet, i.e., determines whether a recording medium has been supplied to a predetermined recording section. At the home position, the recovery process can be performed to maintain a satisfactory ink discharge state for the recording head 9. In addition to the wiping operation by a wiper the recovery process may include a process (preliminary discharge) for discharging, from the recording head 9 to the inside of the cap member, ink that does not contribute to image recording, and a process for exerting a suction force or a pressurizing force to remove, from the recording head 9, ink that does not contribute to image recording.

The recording head 9 in this embodiment is a so-called bubble jet (registered trade mark) recording head, in which thermal energy is used to perform the film boiling of ink to produce a state change, which includes the generation of bubbles, and from which ink droplets are discharged by pressure of the bubbles.

Provided for the recording head 9 are m (e.g., 64) discharge orifices and m corresponding discharge heaters (electro-thermal converting elements). A driver 111 that drives the discharge heaters in the recording head 9 in accordance with a record data signal. And a power source unit 120, which incudes an AC adaptor and a battery, as a drive power source device, for supplying power to the individual sections. With this configuration, the MPU 102 is connected to a host, such as a computer, through the PPI 101, and controls the recording operation based on commands and record data received from the host, procedures for the program stored in the control ROM 105 and record data stored in the RAM 106.

Figure 4:
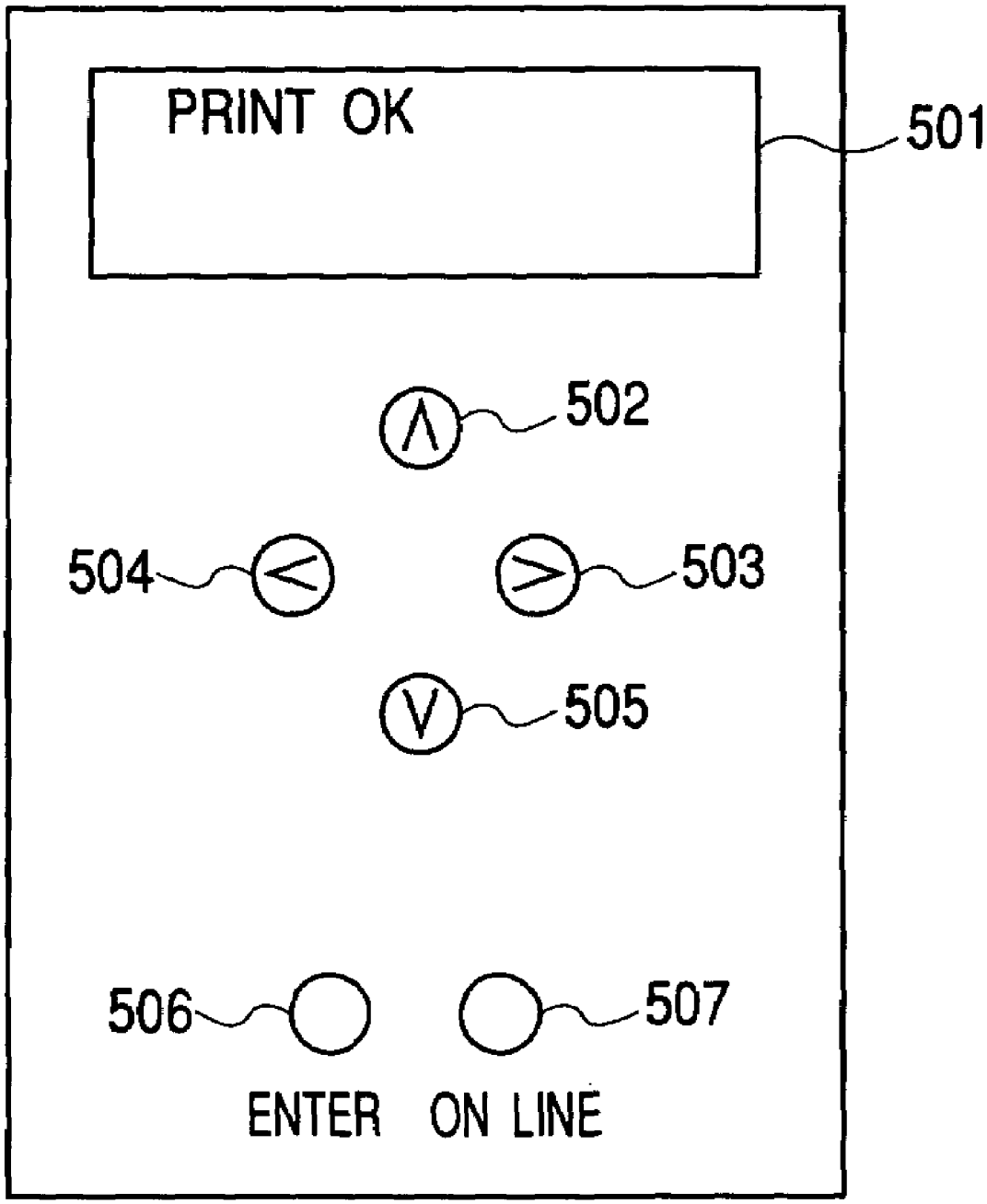
FIG. 4 is a schematic diagram showing an example of a display panel and an example of a partial key operating panel provided for an outer printer case in FIG. 1.

FIG. 4 is a diagram showing an example display panel and an example key operating panel provided for the outer case of the recording apparatus in FIG. 1. For this panel, a display portion and a key operating portion may be integrally formed as a single unit.

In FIG. 4, a liquid crystal display device 501 represents 16 characters arranged in two rows. This display is controlled by the MPU 102 in FIG. 3, and messages concerning the state of the recording apparatus, such as "print OK", "off line" and "paper jam", are displayed in accordance with the printing condition.

The key operating panel includes up, down, left and right keys 502, 505, 504 and 503 and an enter key 506. These keys are manipulated by a user to select a menu for, for example, the setting of a paper type, execution of printing necessary for printing adjustment, or the manual maintenance of a recording head. An on-line key 507 is depressed to switch between the on-line state and the off-line state.

Figure 5:
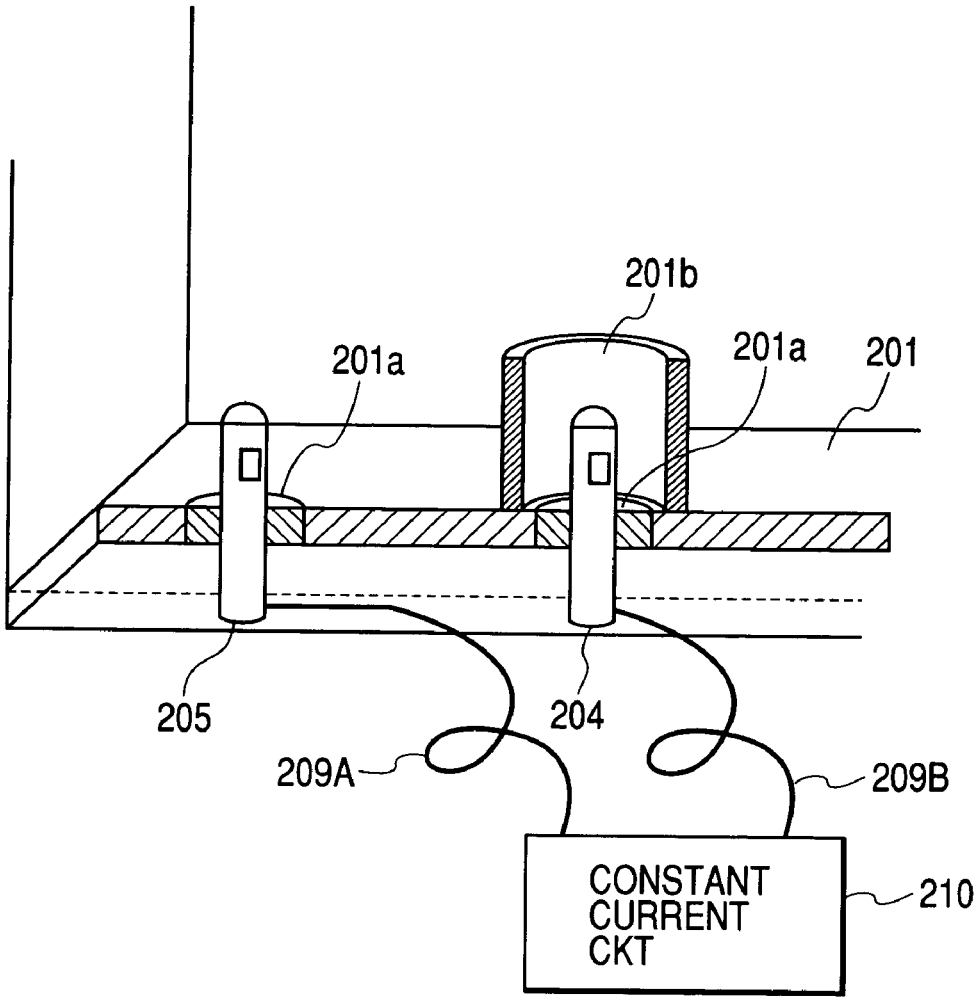
FIG. 5 is an enlarged cross-sectional view of the vicinity near the bottom of the ink tank of the recording apparatus in FIG. 1.

FIG. 5 is a diagram showing example hardware ink detection means. The hardware ink detection means can be provided by using as electrodes, for example, a supply pin 205 and an air communication pin 204 in FIG. 5. That is, the supply pin 205 and the air communication pin 204 are formed of conductive metal, and, the ends of conductive lines 209A and 209B are connected to these pins. The other ends of the conductive lines 209A and 209B are connected to a constant current circuit 210.

The constant current circuit 210 is designed to supply a direct current of 100 μA between the pins 204 and 205 at a maximum voltage of 5 V. Therefore, when there is no ink in the main ink tank 201, or when the main ink tank 201 has not been mounted, the maximum voltage of 5 V is applied to the pins 204 and 205. But when an electrical connection between the pins 204 and 205 is established through ink retained in the main ink tank 201, the voltage that is applied is changed in accordance with the resistance of the ink.

Based on the change in the applied voltage, the detection means detects the presence of ink in the main ink tank 201.

As is shown in FIG. 5, rubber joints 201*a* are located at two places in the bottom of each of the individual color ink containers 201Y, 201M, 201C and 201B of the main ink tank 201, and the pins 204 and 205 of the main body of the recording apparatus are inserted into the joints 201*a*. The supply pins 205 are used to supply ink from the main ink tank 210 to the recording head 9, while the air communication pins 204 is used to introduce the outside atmosphere into the main ink tank 201 as the negative pressure in the main ink tank 201 is increased in accordance with the supply of ink. Ring-shaped walls 201*b* having a predetermined height are internally formed on the inside of the joints 201*a* into which the air communication pins 204 are inserted, so that the joints 201*a* are enclosed by the walls 201*b*.

Figure 6:
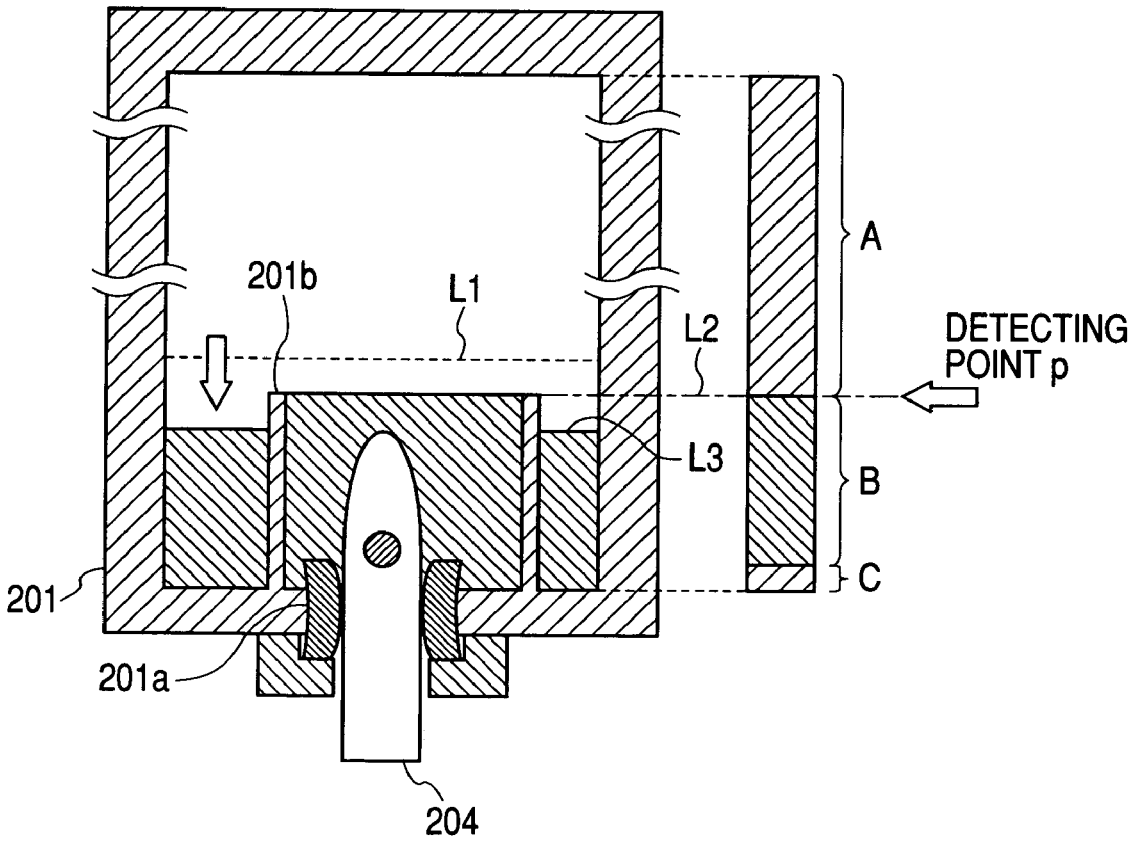
FIG. 6 is a diagram for explaining a method for displaying a warning for the remaining amount of ink.

FIG. 6 is a diagram for explaining the principle for detecting the fall of the ink in the main ink tank 201 to a predetermined volume or lower. As is indicated by levels L1, L2 and L3 in FIG. 6, the liquid surface of the ink in the main ink tank 201 is gradually lowered in accordance with the amount of ink that is consumed. When the liquid surface of the ink is at level L1, i.e., higher than the upper end of the ring-shaped wall 201*b* that encloses the air communication pin 204, the air communication pin 204 and the supply pin 205, which serve as electrodes, are electrically connected through the ink exists over the ring-shaped wall 201*b* in the main ink tank 201. When the liquid surface of the ink is lowered to level L2, i.e., is lower than the upper end of the ring-shaped wall 201*b*, the ink is separated by the ring-shaped wall 201*b* into two pieces of ink, that is, ink in the inside the ring-shaped wall 201*b* and ink in the outside the ring-shaped wall 201*b*, so that the pins 204 and 205 are not connected through the ink. Therefore, when the liquid surface of the ink reaches the level L2, i.e., the upper end of the ring-shaped wall 201*b*, this is assumed to be as a border (a detection point P) and the voltage applied to the pins 204 and 205 is changed.

Based on the change in the applied voltage, the hardware detection means detects the time when the liquid surface of ink reached the level L2.

When the amount of ink remaining in the main ink tank 201 is within a range A in FIG. 6, the remaining amount of ink can be calculated by using the amount of ink consumed for one dot. That is, the amount of ink consumed for one dot is multiplied by the count value held by a dot counter, and the product value is subtracted from the amount of ink that completely fills the main ink tank 201. Then, the remaining amount of ink in the range A can be obtained. The dot count value is the number of ink droplets discharged through the recording head 9, and is reset when the main ink tank 201 is replaced with a new one.

The dot counter constructs, with counter value determination means, the remaining ink amount detection means. Since the remaining ink amount detection means can be provided as a software program, hereafter, this means is also referred to as "software detection means".

At the detection point P, the hardware detection means detects that the liquid surface of the ink has reached the level L2. In a range B in FIG. 6, beginning at the detection point P, the calculation of the remaining amount of ink is continued, and based on the obtained remaining amount of ink, the detection means detects the fall of the remaining ink to a range C, and determines that the supply of ink has been exhausted.

Figure 7:
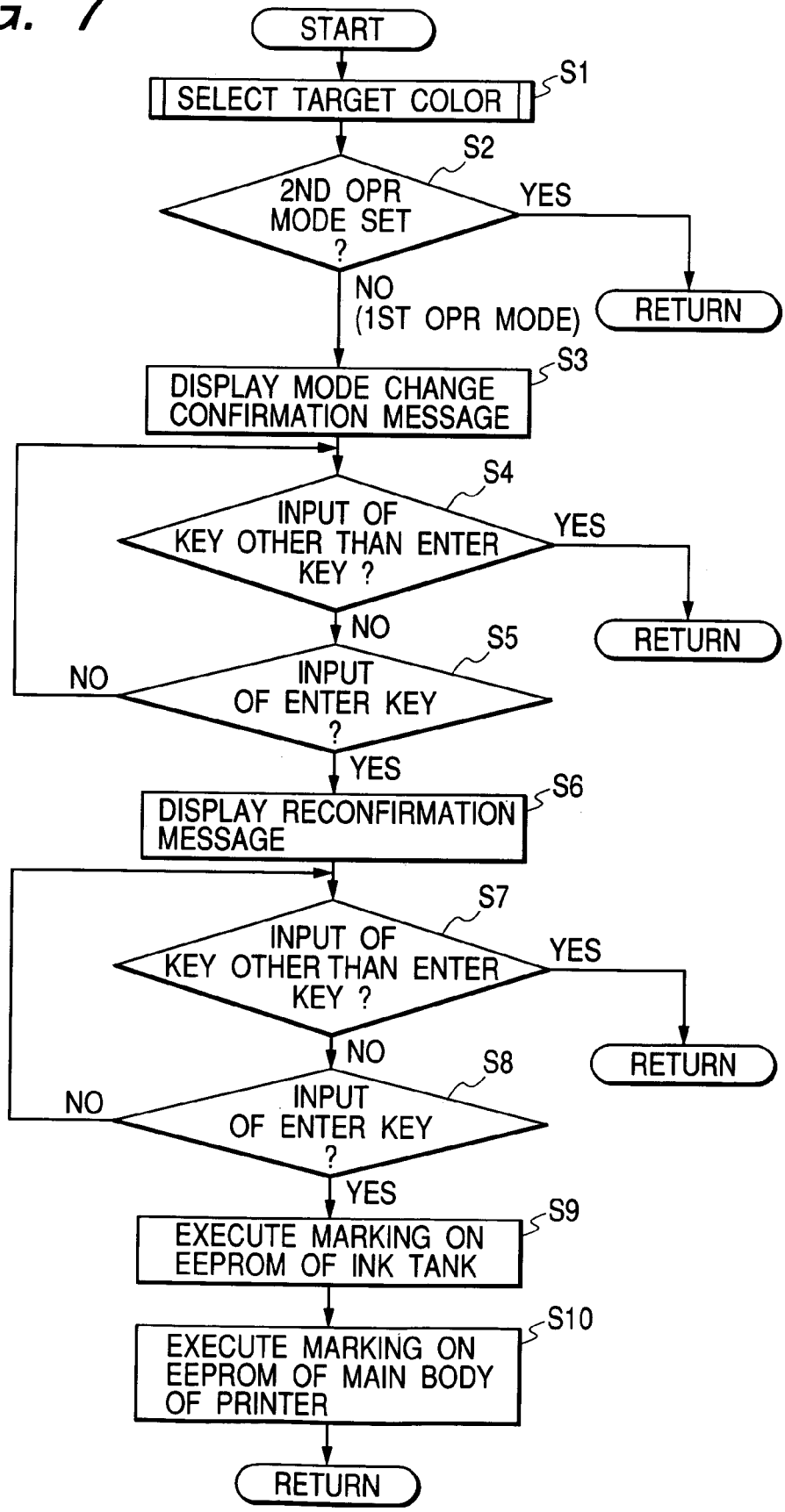
FIG. 7 is a flowchart for explaining the operating mode changing processing.

FIG. 7 is a flowchart for explaining in operation performed when the remaining amount of ink on which the management process is based has reached zero, that is, an operation for switching the operating mode to a "first operating mode" or a "second operating mode. In the following explanation, "switching" between the operating modes is employed, but the operating mode is actually changed by selection. Thus, "changing" of the operating mode may be employed.

The switching operation is performed by manipulating the keys on the operating panel in FIG. 4. First, an ink color is designated for which the first operating mode is to be switched to the second operating mode. Then the recording apparatus is set to the off-line state and a second operating mode select menu, which is one of the menus, is selected by using the direction key, and an ink color to be changed is selected (step S1).

Since data indicating whether the pertinent ink (or tank container) is set to the second operating mode is stored in the EEPROM that is mounted on the selected ink tank (hereinafter referred to as "second operating mode setup marking"), the EEPROM mounted on the selected ink tank is read to determine whether there is a second operating mode setup marking (step S2). When a second operating mode setup marking is already present, the processing is terminated.

When the second operating mode setup marking is not present, it is assumed that currently the first operating mode is set. So, to designate the second operating mode, a change confirmation message is displayed on the display portion in FIG. 4 (step S3). This message is, for example, "Is remaining ink amount detection set to OFF?".

When a key other than the enter key 506 in FIG. 4 has been manipulated, it is assumed that the operating mode switching processing has been halted, and the processing is terminated (step S4). When the enter key 506 has been manipulated, program control branches to step S6 (step S5). When the enter key 506 has not been manipulated, program control returns to step S4 and the process is repeated until any one of the keys is manipulated.

A change reconfirmation message for designating the second operating mode is displayed on the display portion in FIG. 4 (step S6). This message is, for example, "Change OK?".

When a key other than the enter key 506 in FIG. 4 is manipulated, it is assumed that the operating mode switching processing has been halted and the processing is terminated (step S7). When the enter key 506 in FIG. 4 is manipulated, program control branches to step S9 (step S8). But when the enter key 506 is not manipulated, program control returns to step S7 and the process is repeated until any one of the keys is manipulated.

At step S9, the second operating mode setup marking is written in the EEPROM mounted on the selected ink tank. Then, history information indicating that ink for the second operating mode setup has been used is written in the EEPROM mounted on the main body of the recording apparatus (step S10).

The writing of the history information is performed under the control of the MPU 102, the control means, in FIG. 3. However, to perform this writing, another writing device may be provided.

Based on the history information, the main body of the printing apparatus can manage the history indicating that, when the remaining amount of ink on which the management process is based has reached zero, the user selected the second operating mode and the recording operation will be continued. In addition, not only for the currently mounted ink tank, but also for ink tanks that were replaced, the main body of the printing apparatus manages, for an extended period of time, the history indicating that the operating mode was changed to the second operating mode after the remaining amount of ink on which the management process is based became zero. In addition, the history indicating that ink tanks were exchanged and the number of times that the operating mode was changed to the second operating mode can also be managed as history information.

This history information can be managed as information that a maker and a maintenance person can refer to, and with this arrangement, a person who maintains the main body of the printing apparatus and a person who repairs a malfunctioning printing apparatus can understand the usage history for the printing apparatus, and can utilize the information for the maintenance and repair jobs.

In this embodiment, only a change from the first operating mode to the second operating mode is permitted.

This is based on the following idea. Once the first operating mode has been changed to the second operating mode, thereafter, the remaining amount of ink can not be correctly managed, so that it is required that user manipulation can not be used to return to the first operating mode from the second operating mode. However, in this invention, it is also possible for the first operating mode and the second operating mode to be freely designated.

In this embodiment, the information for the operating mode is written in the EEPROM provided for the main ink tank 201. However, this information may be stored in the EEPROM provided for the main body.

Figure 8:
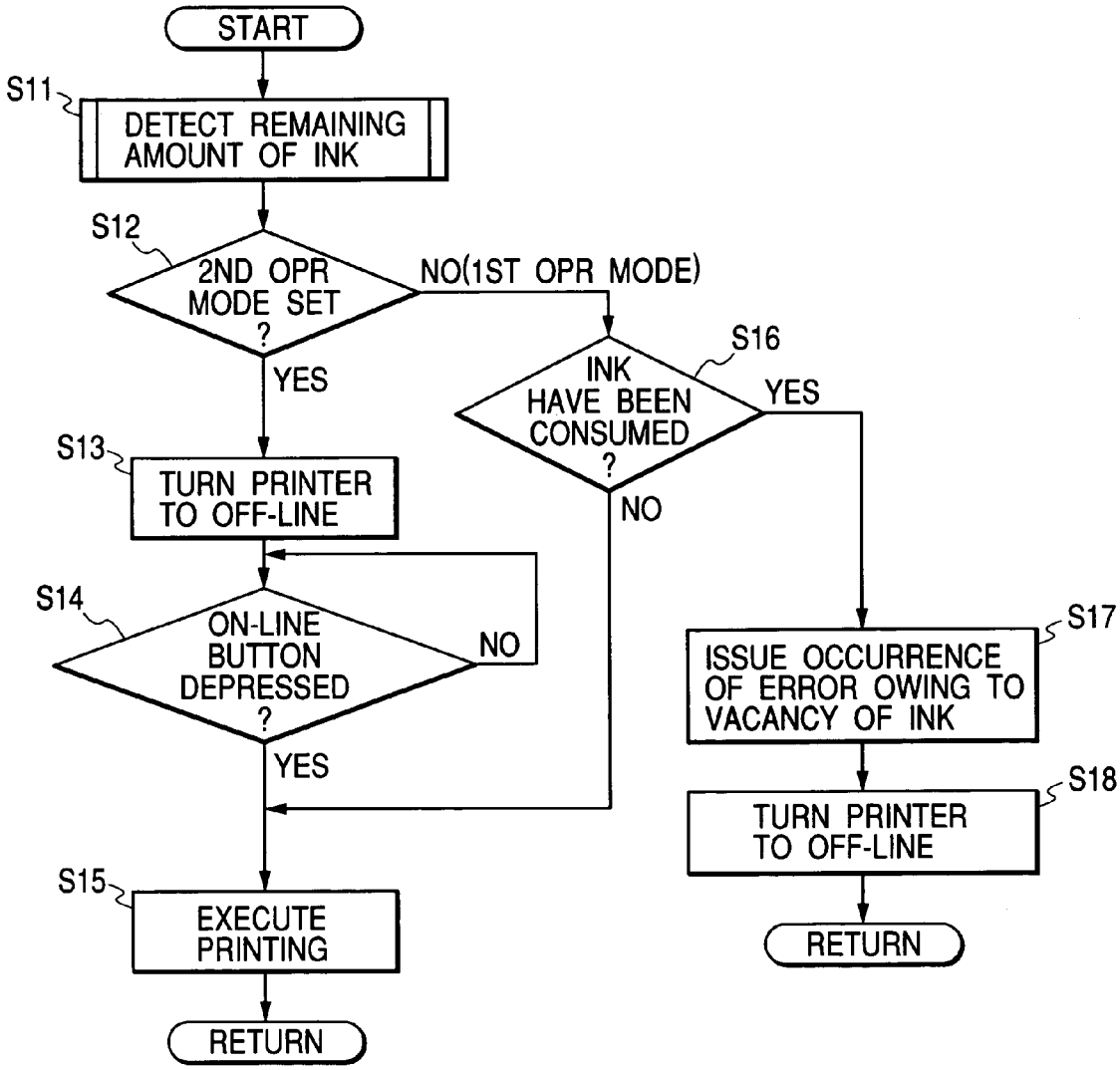
FIGS. 8 and 9 are flowcharts for explaining the processing performed when the recording operation is initiated.

FIG. 8 is a flowchart for explaining the processing performed when the recording operation is initiated.

In the processing in FIG. 8, first, before the recording operation is initiated, the remaining amount of ink is detected (step S11). Then, the data in the EEPROM provided for the main ink tank 201 is read, and the presence of the second operating mode setup marking is confirmed to determine whether the "first operating mode" or the "second operating mode" has been set (step S12). When it is ascertained at step S12 that the "first operating mode" has been set, program control branches to step S16. And when the "second operating mode" has been set, program control advances to step S13.

First, an explanation will be given for a case wherein the first operation mode has been set. This case represents a condition wherein the management of the remaining amount of ink has been performed correctly. A check is performed to determine whether ink has been exhausted (step S16). And when ink has been exhausted, program control branches to step S17. At step S17, the printing operation is halted with the consumption that no ink is available, and an error is issued. In this case, printing is not performed, and the printing apparatus is set to the off-line state (step S18). Thereafter, the processing is terminated.

When it is determined at step S16 that ink is available, program control branches to step S15, normal recording is performed, and thereafter, the processing is terminated. The purpose for which, in the first operating mode, the remaining amount of ink is managed is the protection of the recording head by inhibiting printing when ink has been exhausted. It is apparent from the explanation given for the flowchart that an operation consonant with this purpose is performed.

An explanation will now be given for a case wherein the second operating mode is set. In the second operating mode, when the remaining amount of ink, on which the management process is based, has reached zero, continuous performance of the recording operation is enabled by user manipulation. For example, even when the remaining amount of ink on which the management process is based has reached zero, the recording operation is continued by using the slight amount of ink actually remaining in the ink tank. Therefore, in this operating mode, the recording operation is performed without the remaining amount of ink being managed.

When it is determined at step S12 that the current operating mode is the second operation mode, the recording apparatus is set to the off-line state (step S13), and thereafter, the recording operation is paused until the user depresses the on-line button provided for the recording apparatus (step S14). When the on-line button is depressed by the user, program control branches to step S15 and normal printing is performed. Thereafter, the processing is terminated. That is, in the second operating mode, upon the reception of the instruction for the recording operation, it is confirmed that a predetermined operation has been performed by the use of the manipulation means provided for the recording apparatus. When the predetermined operation (in this case, the change to the on-line state) has been performed by the user, the recording operation is initiated.

As is described above, when the recording operation is to be started, the user is requested to depress the on-line button, and thus, the user is notified that an operating mode has been set for which the management, by the recording apparatus, of the remaining ink is invalid. Further, since at the main body of the printing apparatus user manipulation is performed and the recording operation is initiated by the depression of the on-line button, more opportunities are provided for the user to confirm the recorded results. Since generally the instruction to start the recording operation is issued by a host apparatus other than the printing apparatus, and since for the second operating mode user manipulation at the main body of the recording apparatus is required, the user is requested to pay attention to the main body of the printing apparatus and the printed results. Therefore, even when the remaining ink is not managed, the user is apprised, at a comparatively early time, of the state wherein the remaining amount of ink has actually reached zero and the recording operation will not be performed normally. Therefore, even when the recording operation is continued after the supply of ink has been exhausted, the possibility that the recording head will be adversely affected can be reduced, and damage to the recording head can be avoided.

Furthermore, as explained in this embodiment, the change to the second operating mode is stored as history information in the EEPROM constituting the storage means for the main body. Therefore, even when the ink supply system is converted by the user in order to continue the recording operation after the remaining amount of ink on which the management process is based has reached zero, a maintenance person can confirm the history information to ascertain that the operating mode was changed to the second operating mode. Therefore, the maintenance person can identify or estimate the factor that a failure occurred at the main body or the recording head.

As is described above, since in this embodiment the user is requested to depress the on-line button for the recording operation, the user is thus apprised that the second operation mode has been set wherein the recording operation can be continued even after the remaining amount of ink, on which the management process is based, has reached zero.

The above described operating panel 123 in FIG. 4 is used to issue the instruction for the on-line state. However, the mechanism of the recording apparatus that is manipulated by the user is not limited to that shown in FIG. 4, and simply an on-line button may be provided for the main body of the recording apparatus.

In the second operation mode, when the recording operation is instructed, it is conducted after the user has manipulated the button. This control is performed by the MPU 102, the control means, in FIG. 3. In this embodiment, as is described above, an explanation has been given for a case where when the recording operation is instructed in the second operating mode, it is performed after the user has designated the on-line state. However, the recording operation may be started by performing another operation, such as the manipulation of a recording start button or a recording resumption button.

Second Embodiment

A second embodiment for the present invention will now be described while referring to the drawings.

Since the basic configuration of an ink jet recording apparatus description on the remaining amount of ink and the processing shown in FIG. 7 are the same as those for the first embodiment, no further explanation for them will be given.

Figure 9:
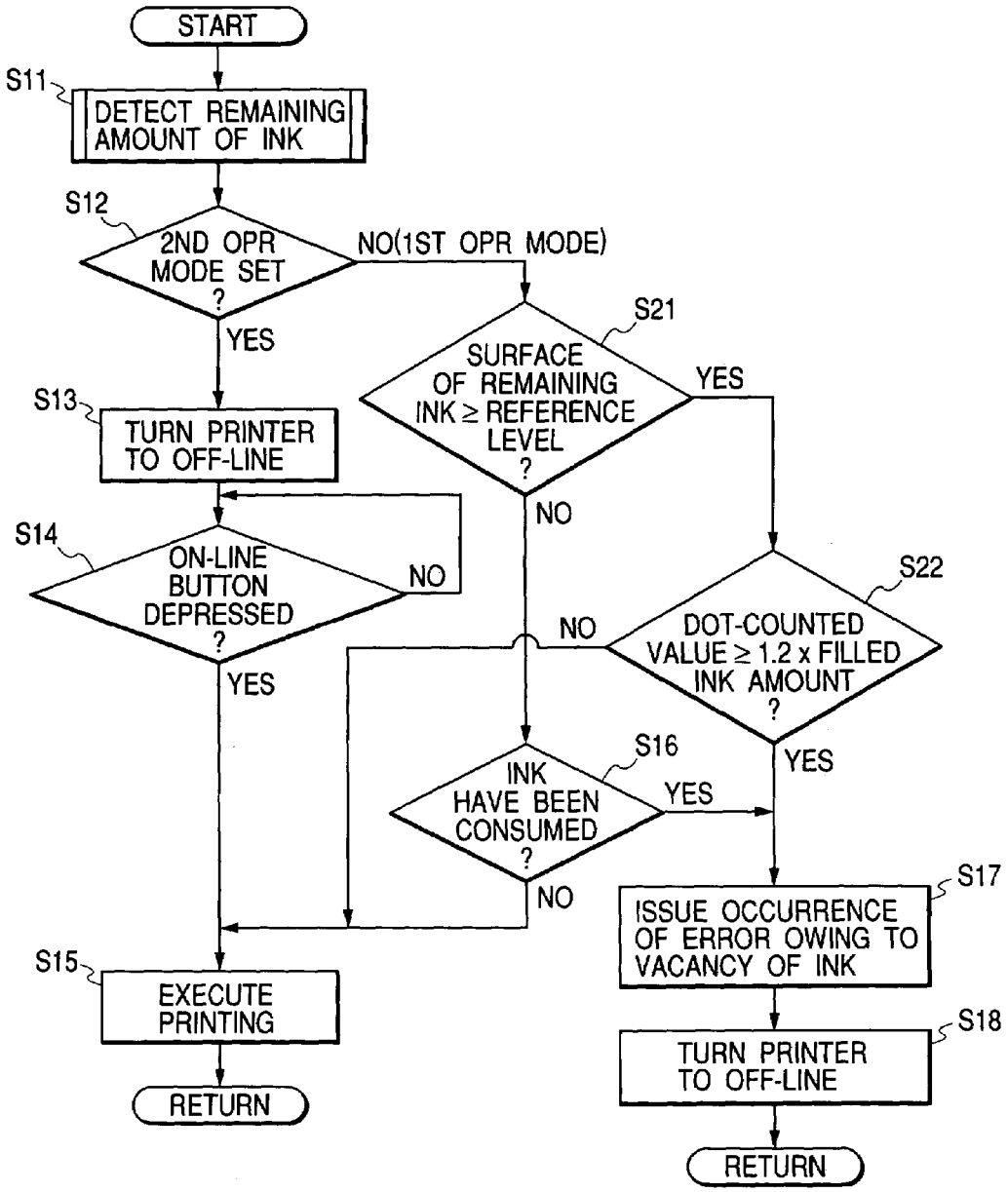

In the second embodiment, the processing in FIG. 8 for the first embodiment is replaced with the processing shown in FIG. 9. This processing will now be described.

FIG. 9 is a flowchart for explaining the processing performed when the recording operation is initiated. The same steps as in FIG. 8 are employed to denote the like processes in FIG. 9.

In the processing in FIG. 9, when the recording apparatus (or printer) is employed while more ink is consumed than the remaining amount of ink on which the management process is based, the state wherein the operation of the main body of the recording apparatus exceeds the usage that is expected for the recording apparatus can be detected, and it is informed to the user.

First, before the recording operation is started, the remaining amount of ink is detected (step S11). Then, the data is read from the EEPROM provided for the ink tank to confirm the presence of the second operating mode setup marking, and whether the "first operating mode" or the "second operating mode" has been set is determined (step S12). When the "first operating mode" has been set, program control branches to step S21. Whereas when the "second operating mode" has been set, program control advances to step S13.

First, an explanation will be given for a case wherein the operation mode is set to the first operating mode. In this case, the management of the remaining amount of ink is performed normally. First, at step S21, it is checked whether the liquid surface of the ink is lower than the level L2 in FIG. 6. At step S21, the ink detection means in FIG. 6, which includes the mechanically configured electrodes, is employed to detect the remaining amount of ink. When it is determined at step S21 that the liquid surface of ink is lower than the level L2 in FIG. 6, program control branches to step S16. When the liquid surface of the ink is equal to or above the level L2, program control branches to step S22. When the liquid surface of the remaining ink is below the level L2, the presence absence of ink (whether the amount of remaining ink falls in the range C in FIG. 6) is determined based on a dot count value. When ink has been exhausted, the recording process is halted while it is assumed that no ink remains and an error is issued (step S17). In this case, recording is not performed, and the recording apparatus is set to the off-line state (step S18). The processing is thereafter terminated.

When it is determined at step S16 that there is ink remaining, program control branches to step S15 and the normal recording processing is performed. Thereafter, the processing is terminated.

When it is determined at step S21 that the liquid surface of the ink is equal to or higher than the level L2 in FIG. 6, program control is shifted to step S22. At step S22, the amount of ink that has been consumed is calculated by using the dot count method to determine whether the amount of ink originally filled has been exceeded.

When the dot count method is used, there is an error, to a degree. However, when the liquid surface of the remaining ink is equal to or higher than the level L2 in FIG. 6, if the calculated amount of ink that has been consumed is over 1.2 times an amount of the ink filled it can be assumed that the main body of the recording apparatus is in an unexpected usage state.

When the amount of ink consumed exceeds 1.2 times the ink fill capacity, program control is shifted to step S17, whereat the recording processing is halted and an error is generated. In this case, recording is not performed, and the recording apparatus is set to the off-line state (step S18). Thereafter, the processing is terminated.

When for the ink consumed the amount calculated by the dot count method does not exceed 1.2 times the ink fill capacity, it is assumed that the main body of the recording apparatus is in the normal usage state, or that the recording apparatus is operating normally. Program control then moves to step S15, and the normal recording operation is performed. Thereafter, the processing is terminated.

When the dot count method is used, there is an error, to a degree, in the calculated amount of ink consumed or in the calculated amount of ink remaining. When the ink discharged is less than the normal amount, due to a defect in the ink supply system or a recording head discharge abnormality, the amount of ink remaining, as estimated by using the dot count method, greatly differs from the actual amount of ink remaining. In this case, since an image to be recorded is also adversely affected, in this embodiment so that it is assumed that such an abnormal state has occurred, the recording operation is halted and a user can be notified that an abnormal state exists.

Furthermore, as before-mentioned, when the recording apparatus is in an unexpected usage state because a user has accessed to the ink supply system, the dot counter value in the first operating mode may reach a value that greatly exceeds the amount of ink filled in the ink tank. In a usage state that is unexpected by a maker, the probability is increased that the main body of the recording apparatus and the recording head will be damaged. Therefore, according to this embodiment, when a user has modified the apparatus so its performance exceeds the range that the maker can guarantee, the probability that the main body of the recording apparatus and the recording head will be damaged can be reduced.

The same processing as in the flowchart in FIG. 8 is performed when it is determined at step S12 in FIG. 9 that the current setting is the second operating mode, and no further explanation for it will be given.

Through the processing for the second operating mode, as in the first embodiment, the user can be requested to pay attention to the main body of the recording apparatus and the printed results. Therefore, even when the management of the remaining amount of ink is not performed, the user can be apprised comparatively early of a state wherein the supply of ink has actually been exhausted and the recording operation is not being performed correctly. As a result, even when the recording operation is continued after the ink supply has been exhausted, the adverse affect on the recording head can be reduced, and damage to the recording head can be prevented.

According to the first embodiment and the second embodiment, in the second operating mode, as in the processing shown in FIGS. 8 and 9, the recording apparatus (or printer) is set in the on-line state at the recording start, and is changed to the on-line state by the user, so that an opportunity is provided for the user to confirm the state of the main body of the recording apparatus. However, in the following recording operation, e.g., in a continuous recording operation performed for several to several tens of pages, the off-line state may be changed to the on-line state each time the recording of a page or of several pages is performed. When the remaining amount of ink on which the management process is based reaches zero, it is especially difficult for the main body of the recording apparatus to manage the time whereat the ink is actually exhausted. Therefore, when the opportunity to permit the user to manipulate the main body is provided comparatively frequently, at each opportunity the user can confirm the state of the main body of the recording apparatus and the printed results. Therefore, even when the recording is disabled because the actual remaining amount of ink is zero, the user can be apprised of this state comparatively early, so that not only can the wasting of the recording sheets can be prevented, but damage to the recording head or the main body of the recording apparatus can be minimized.

As for the modification by the user of the ink supply system, there is a case wherein ink having a composition other than the one available for the main body of the recording apparatus, or another liquid, is supplemented. Even when the ink supply system is converted by the user, it is preferable that damage to the main body of the recording apparatus or the recording head be minimized to the extent possible. If an abnormality occurs as a result of this conversion, an opportunity must be provided that permits the user to manipulate the main body of the apparatus must be provided, so that the user can be notified of the abnormality comparatively early. As a result, the service life of the main body of the recording apparatus or the recording head can be extended, and the running cost for of the recording apparatus can be reduced.

As is described above, according to the present invention, when the remaining ink on which the management process is based reaches zero, the first operating mode for performing the normal recording operation can be changed to the second operating mode for enabling the recording operation without the remaining amount of ink being managed. In the second operating mode, the recording operation is performed by the user manipulation at the main body of the recording apparatus. Therefore, under a condition wherein the remaining amount of ink is not managed, a user can be apprised early of a detect or an abnormality that occurs when the remaining amount of ink actually reaches zero. As a result, the damage that could be caused to the main body of the recording apparatus or the recording head can be suppressed, and the service life of the main body or the recording head can be increased.

What is claimed is:

1. An ink jet recording apparatus fir discharging ink supplied from an exchangeably mounted ink tank to a recording medium through a recording head to thereby perform recording, said ink jet apparatus being connectable to an external host, said ink jet apparatus comprising:

operating means for operating the ink jet recording apparatus and for changing a setup, wherein said operating means includes on-line switching means for switching the state of connection to the host between an on-line state and an off-line state;

remaining amount management means for managing a remaining amount of ink in the mounted ink tank;

mode change means for switching between a first operating mode and a second operating mode when it is determined that following the consumption of ink, the remaining amount of ink in the ink tank managed by the remaining amount management means has reached zero, wherein in the first operating mode a recording operation using the recording head is inhibited after the remaining amount managed by the remaining amount management means has reached zero, and wherein in the second operating mode continuance of the recording operation is enabled regardless of the remaining amount managed by the remaining amount management means; and control means for, when performance of the recording operation is instructed in the second operating mode, permitting the performance of the recording operation after a user's manipulation through the operating means, wherein when the performance of the recording operation is instructed in the second operating mode, the control means sets the state of the connection to the host to the off-line state, and then permits the performance of the recording operation after the user manipulates the on-line switching means to change the state to the on-line state.

2. An ink jet recording apparatus according to claim 1, wherein, each time a predetermined number of copies is recorded in the second operating mode, the control means sets the connection state to the host to the off-line state.

3. An ink jet recording apparatus according to claim 1, wherein the ink tank includes a storage element for storing the remaining amount of ink tat is managed by the remaining amount management means; and wherein, when the operating mode is changed to the second operating mode, the control means stores, in the storage element of the ink tank, information representing the change to the second operating mode.

4. An ink jet recording apparatus according to claim 1, further comprising;

storage means for storing the remaining amount of ink managed by the remaining amount management means, wherein when the operating mode is changed to the second operating mode, the control means causes said storage means to store, in the storage means of the ink jet recording apparatus, information representing the change to the second operating mode.

5. An ink jet recording apparatus according to claim 1, further comprising:

remaining amount detection means for detecting when the remaining amount of ink in the ink tank reaches a level equal to or lower than a predetermined level;

wherein when, in the first operating mode, the remaining amount detection means has not yet detected that the remaining amount of ink reaches a level equal to or lower than the predetermined level, and when the remaining amount managed by the remaining amount management means has exceeded a predetermined amount, the control means inhibits the performance of the recording operation.

6. An ink jet recording apparatus according to claim 5, wherein the predetermined amount is more than the amount of ink with which the ink tank was initially filled.

7. A method of controlling an ink jet recording apparatus for discharging ink supplied from an exchangeably mounted ink tank discharged to a recording medium through a recording head to thereby perform recording, said ink jet apparatus being connectable to an external host, said method comprising the steps of:

switching between a first operating mode and a second operating mode when a remaining amount of ink to be managed is reduced, wherein in the first operating mode the performance of a recording operation is inhibited and in the second operating mode the performance of the recording operation is enabled; and confirming, when performance of the recording operation is instructed in the second operating mode, whether a predetermined manipulation has been performed by a user of the ink jet recording apparatus; and controlling the performance of the recording operation to be permitted after the predetermined manipulation has been performed by the user;

wherein said ink jet recording apparatus includes on-line switching means for switching the state of connection to the host between an on-line state and an off-line state; and wherein said confirming step includes the step of switching the state of the connection to the off-line state, and said predetermined operation includes the user's manipulation of the on-line switching means to the on-line state.

* * * * *

UNITED STATES PATENT AND TRADEMARK OFFICE

CERTIFICATE OF CORRECTION

PATENT NO. : 7,059,700 B2
APPLICATION NO. : 10/765992
DATED : June 13, 2006
INVENTOR(S) : Yoshihiko Aihara It is certified that error appears in the above-identified patent and that said Letters Patent is hereby corrected as shown below:

ON THE TITLE PAGE

--(30) Foreign Application Priority Data

Feb. 3, 2003 (JP) .....2003-025779-- should be inserted.

COLUMN 1

Line 28, "undergo," should read --undergo--.

COLUMN 6

Line 15, "is provide" should read --is provided--; and

Line 51, "temporally" should read --temporarily--.

COLUMN 11

Line 5, "consumption" should read --determination--.

COLUMN 13

Line 14, "presence absence" should read --presence or absence--.

COLUMN 14

Line 48, "can be" should read --be--.

COLUMN 15

Line 9, "detect" should read --defect--; and

Line 59, "ink tat" should read --ink that--.

Signed and Sealed this

Second Day of January, 2007

JON W. DUDAS

*Director of the United States Patent and Trademark Office*